US008915624B2

(12) United States Patent
Manahan

(10) Patent No.: US 8,915,624 B2
(45) Date of Patent: Dec. 23, 2014

(54) COOLING HEAT-GENERATING COMPONENTS OF A LIGHT FIXTURE

(75) Inventor: Joseph Michael Manahan, Manlius, NY (US)

(73) Assignee: Cooper Technologies Company, Houston, TX (US)

( * ) Notice: Subject to any disclaimer, the term of this patent is extended or adjusted under 35 U.S.C. 154(b) by 235 days.

(21) Appl. No.: 13/477,914

(22) Filed: May 22, 2012

(65) Prior Publication Data

US 2013/0314929 A1 Nov. 28, 2013

(51) Int. Cl.
*F21V 29/02* (2006.01)
*F21V 29/00* (2006.01)

(52) U.S. Cl.
CPC ..... *F21V 29/20* (2013.01); *F21V 29/02* (2013.01)
USPC ..... 362/373

(58) Field of Classification Search
CPC ..... F21V 29/02; F21V 29/025; F21V 29/027; F21V 3/00; F21V 15/011; F21V 29/20
See application file for complete search history.

(56) References Cited

U.S. PATENT DOCUMENTS

| | | | | |
|---|---|---|---|---|
| 3,068,341 | A * | 12/1962 | Ortiz et al. | 219/220 |
| 4,681,024 | A * | 7/1987 | Ivey | 454/233 |
| 5,093,769 | A * | 3/1992 | Luntsford | 362/269 |
| 5,653,519 | A | 8/1997 | Dobbs | |
| 6,227,686 | B1 * | 5/2001 | Takahashi et al. | 362/345 |
| 6,353,295 | B1 | 3/2002 | Sridhar et al. | |
| 6,885,134 | B2 | 4/2005 | Kurashima et al. | |
| 7,380,963 | B2 | 6/2008 | Maes et al. | |
| 7,524,089 | B2 | 4/2009 | Park | |
| 7,578,594 | B2 | 8/2009 | Souza et al. | |
| 7,837,363 | B2 | 11/2010 | Liu | |
| 2002/0141195 | A1 | 10/2002 | Peter | |
| 2009/0310373 | A1 | 12/2009 | Burkhauser | |
| 2009/0323361 | A1 * | 12/2009 | Liu | 362/373 |
| 2010/0085759 | A1 | 4/2010 | O'Sullivan et al. | |
| 2010/0149807 | A1 | 6/2010 | Hu et al. | |
| 2010/0165632 | A1 | 7/2010 | Liang | |
| 2010/0328949 | A1 * | 12/2010 | Lai et al. | 362/249.02 |
| 2011/0267829 | A1 | 11/2011 | Horng et al. | |
| 2012/0008330 | A1 | 1/2012 | Horng et al. | |
| 2013/0182436 | A1 * | 7/2013 | Payne et al. | 362/249.01 |

FOREIGN PATENT DOCUMENTS

| | | |
|---|---|---|
| RU | 74441 | 6/2008 |
| RU | 116253 | 5/2012 |
| SU | 1341446 | 9/1987 |
| WO | 2009090666 | 7/2009 |
| WO | 2010103293 | 9/2010 |

* cited by examiner

*Primary Examiner* — Bao Q Truong
(74) *Attorney, Agent, or Firm* — King & Spalding LLP

(57) ABSTRACT

A system for cooling heat-generating components within a housing of a light fixture is described herein. The system can include an inlet aperture and an outlet aperture in one or more walls of the housing. The system can also include a housing separator that separates the interior of the housing into a number of regions. The system can also include a heat-generating component positioned within the housing. The system can further include an air moving device positioned within the housing. The air moving device can draw intake air from outside the explosion-proof enclosure and pass the intake air over the heat-generating component to generate exhaust air, where the intake air cools the heat-generating component. The air moving device can further remove the exhaust air from the interior of the housing.

30 Claims, 8 Drawing Sheets

COOLING HEAT-GENERATING COMPONENTS OF A LIGHT FIXTURE

TECHNICAL FIELD

The present disclosure relates generally to cooling heat-generating components of a light fixture, and more particularly to systems, methods, and devices for controlling airflow within a light fixture to cool one or more components inside the light fixture.

BACKGROUND

Light fixtures include a number of components. At times one or more of these components generate heat. In an enclosed space, such as a light fixture housing, an excessive amount of heat can lead to decreased performance and/or failure of one or more components inside the housing of the light fixture.

SUMMARY

In general, in one aspect, the disclosure relates to a cooling system for a light fixture. The cooling system can include a housing having a number of walls and a heat-generating component positioned between the walls. The cooling system can also include an inlet aperture in a first wall. The cooling system can further include an outlet aperture in a second wall. The cooling system can also include a housing separator mechanically coupled to at least one of the walls and separating the housing into a first region and a second region, where the first region includes the inlet aperture, and where the second region includes the outlet aperture. The cooling system can further include an air moving device positioned within the housing and mechanically coupled to at least one of the walls.

In another aspect, the disclosure can generally relate to a cooling system for a light fixture. The cooling system can include an inlet aperture in a first wall of a housing of the light fixture, where the housing includes a heat-generating component. The cooling system can also include an inlet covering assembly that is coupled to an outer surface of the housing and covers the inlet aperture, where the inlet covering assembly includes a baffled entrance. The cooling system can further include an outlet aperture in a second wall of the housing. The cooling system can also include an outlet covering assembly that is coupled to the outer surface of the housing and covers the outlet aperture, where the outlet covering assembly includes a baffled exit. The cooling system can further include an air moving device positioned within the housing.

In yet another aspect, the disclosure can generally relate to a method for cooling heat-generating components of a light fixture. The method can include positioning a housing separator within a housing of the light fixture, where the housing separator separates the housing into a first region and a second region, where the first region includes an inlet aperture in a first wall of the housing, and where the second region includes an outlet aperture in a second wall of the housing. The method can also include drawing intake air from outside the light fixture through the inlet aperture into the first region of the housing. The method can further include passing a first portion of the intake air over the heat-generating component to the second region of the housing, where the first portion of the intake air cools the heat-generating component to generate first exhaust air. The method can also include removing the first exhaust air from the second region out of the housing through the outlet aperture, where the housing comprises the heat-generating component.

In still another aspect, the disclosure can generally relate to a cooling system for a light fixture. The cooling system can include an inlet aperture in a first wall of a housing of the light fixture. The cooling system can also include an inlet covering assembly that is mechanically coupled to an outer surface of the housing and covers the inlet aperture, where the inlet covering assembly includes a baffled entrance. The cooling system can further include an outlet aperture in a second wall of the housing. The cooling system can also include an outlet covering assembly that is mechanically coupled to the outer surface of the housing and covers the outlet aperture, where the outlet covering assembly includes a baffled exit. The cooling system can further include a light chamber including a light source mechanically coupled to a heat sink and electrically coupled to a driver positioned within the housing. The cooling system can also include an air moving device positioned within and mechanically coupled to a portion of the housing.

These and other aspects, objects, features, and embodiments will be apparent from the following description and the appended claims.

BRIEF DESCRIPTION OF THE DRAWINGS

The drawings illustrate only exemplary embodiments of cooling heat-generating components of a light fixture and are therefore not to be considered limiting of its scope, as the disclosure may admit to other equally effective embodiments. The elements and features shown in the drawings are not necessarily to scale, emphasis instead being placed upon clearly illustrating the principles of the exemplary embodiments. Additionally, certain dimensions or positionings may be exaggerated to help visually convey such principles. In the drawings, reference numerals designate like or corresponding, but not necessarily identical, elements.

DETAILED DESCRIPTION

Figure 1:
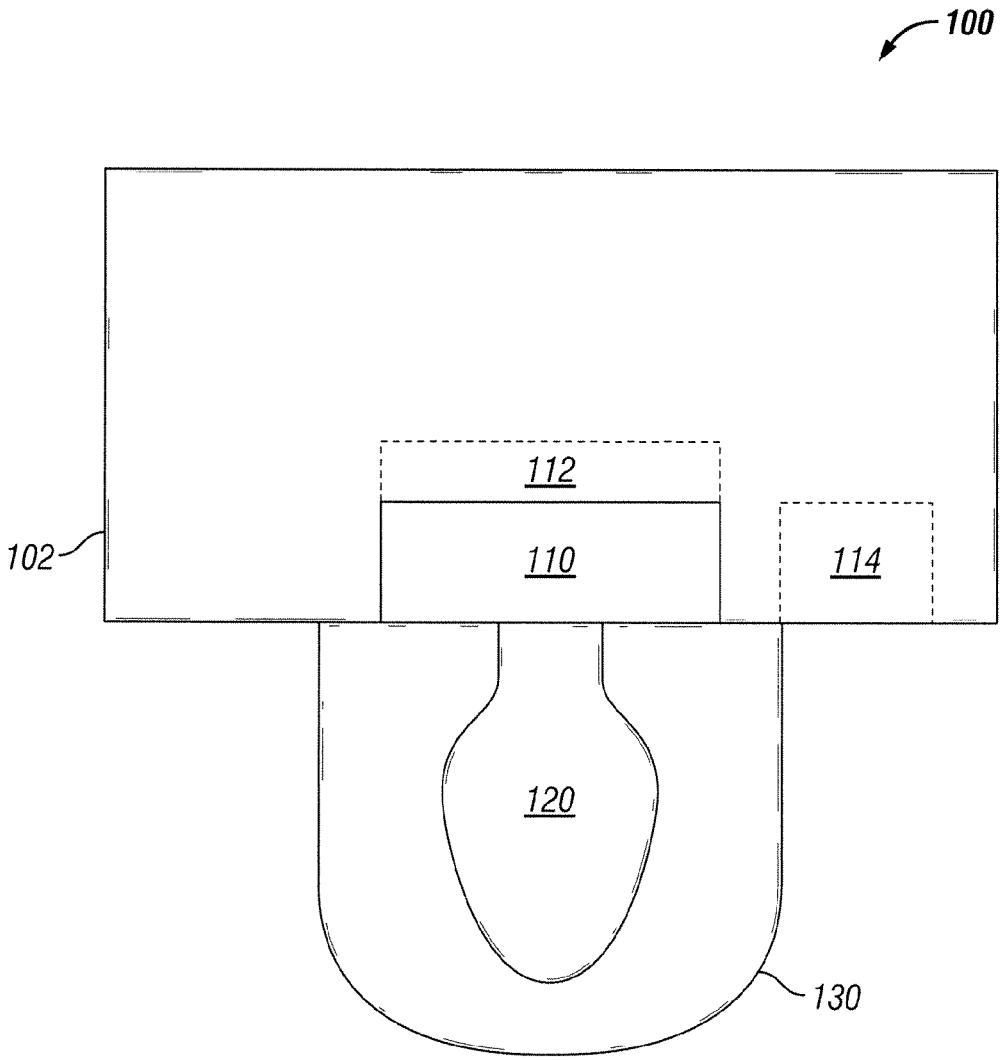
FIG. 1 shows a light fixture in which one or more exemplary embodiments of cooling heat-generating components of a light fixture may be implemented.

Exemplary embodiments of cooling heat-generating components of a light fixture will now be described in detail with reference to the accompanying figures. Like elements in the various figures are denoted by like reference numerals for consistency.

In the following detailed description of exemplary embodiments of cooling heat-generating components (also called heat-generating devices) of a light fixture, numerous specific details are set forth in order to provide a more thorough understanding of cooling heat-generating components of a light fixture. However, it will be apparent to one of ordinary skill in the art that cooling heat-generating components of a light fixture may be practiced without these specific details. In other instances, well-known features have not been described in detail to avoid unnecessarily complicating the description. Further, certain descriptions (e.g., top, bottom, side, end, interior, inside) are merely intended to help clarify aspects of cooling heat-generating components of a light fixture and are not meant to limit embodiments of cooling heat-generating components of a light fixture In general, exemplary embodiments of cooling heat-generating components of a light fixture provide systems, methods, and devices for using an air moving device to pass air through one or more portions of a light fixture to cool one or more heat-generating components. Specifically, exemplary embodiments of cooling heat-generating components of a light fixture provide for using an air moving device to draw inlet air from outside the light fixture to an interior of the light fixture, pass the inlet air over the heat-generating components to cool the heat-generating components, and remove the heated inlet air (i.e., exhaust air) from the light fixture. A heat-generating component is any component of a light fixture that generates and emits heat while operating. A heat-generating component may also, or in the alternative, be a component that absorbs heat generated by a source (e.g., a light source). As a result of absorbing heat from a different source, the heat-generating component gives off some of that absorbed heat. In some cases, the heat radiated by heat-generating components may cause such components and/or other components of the light fixture to deteriorate and/or fail.

Exemplary embodiments discussed herein may be with reference to any type of light fixture. Examples of types of light fixtures may include, but are not limited to, light emitting diode (LED) light fixtures, halogen light fixtures, high-intensity discharge (HID) lamps, incandescent light fixtures, gas discharge lamps, and plasma lamps. Further, a light fixture may be used for one or more of a variety of purposes, including but not limited to residential/commercial use, industrial use, and hazardous condition use.

A user may be any person that interacts with a light fixture or equipment controlled by one or more components of a light fixture. Specifically, a user may program, operate, and/or interface with one or more components (e.g., a controller, a light switch) associated with controlling airflow within a light fixture. Examples of a user may include, but are not limited to, an engineer, an electrician, an instrumentation and controls technician, a mechanic, an operator, a consultant, a contractor, and a manufacturer's representative.

In one or more exemplary embodiments, the heat-generating components inside a light fixture are any components that produce heat energy during operation. A heat-generating component may include, but is not limited to, one or more of a device (e.g., driver, temperature measuring device, controller, heat sink), a light source, a terminal, cable, wiring, a switch, a duct, and a baffle.

FIG. 1 depicts a lighting fixture 100 in which one or more exemplary embodiments of cooling heat-generating components of the light fixture may be implemented. In one or more exemplary embodiments, one or more of the components shown in FIG. 1 may be omitted, repeated, and/or substituted. Accordingly, exemplary embodiments of a light fixture should not be considered limited to the specific arrangements of components shown in FIG. 1.

Referring now to FIG. 1, an example of a light fixture 100 is shown. The light fixture 100 includes a housing 102 and a light chamber 130. The housing 102 includes a driver 110. Optionally, the housing 102 may also include a heat sink 112 and/or a capacitor 114. The light chamber 130 includes a light source 120. Each of these components is described below.

In one or more exemplary embodiments, the housing 102 of the light fixture 100 is an enclosure inside of which the driver 110 and/or one or more other components (e.g., heat sink 112, capacitor 114) are positioned. Collectively, the driver 110, heat sink 112, capacitor 114, and/or any other components of the light fixture 100 that generate heat may be heat-generating devices. Further, the driver 110, heat sink 112, capacitor 114, and/or the light source 120 may be called lighting hardware. The housing 102 may protect the components positioned within the housing 102 from debris, dust, and/or other elements that may cause such components to deteriorate and/or stop working properly. The housing 102 may be made of any suitable material, including metal (e.g., alloy, stainless steel), plastic, some other material, or any combination thereof. The housing 102 may have a size, thickness, weight, shape, and/or other characteristics that comply with a standard, regulation, application, and/or any other requirement of the lighting fixture 100.

In certain exemplary embodiments, the driver 110 in the housing 102 of the light fixture 100 is configured provide power used to generate light at the light source 120. The driver 110 may include one or more of a number of single or multiple discrete components (e.g., transistor, diode, resistor), and/or a microprocessor. The driver may include a printed circuit board, upon which the microprocessor and/or one or more discrete components are positioned. In certain exemplary embodiments, when the driver 110 is operating, the driver 110 generates heat that radiates from the driver 110. In some cases, the heat generated by the driver 110 causes the driver 110 and/or other components of the light fixture 100 to deteriorate and/or fail.

The optional heat sink 112 in the housing 102 of the light fixture 100 is a passive device configured to absorb heat from one or more heat-generating components (e.g., the driver 110) in the housing 102. The heat sink 112 may be configured in one or more of a number of shapes having one or more of a number of features. Such features may include, but are not limited, to a flat surface, and a fin. The heat sink 112 may be made of one or more of a number of materials, including but not limited to aluminum, a metal alloy, copper, diamond, and composite materials.

The optional capacitor 114 in the housing 102 of the light fixture 100 is configured to store energy and subsequently release the energy under certain electrical conditions. The capacitor 114 may be electrically coupled to the driver 110 to smooth the power output of the driver 110 and improve the quality of power delivered to the light source 120. The capacitor 114 may also be a heat-generating component.

Those skilled in the art will appreciate that one or more other components (e.g., resistors, transformers, wiring, terminal blocks) may be located within the housing 102 of the light fixture 100. Such one or more other components may be heat-generating components and/or may be affected by other heat-generating components of the light fixture 100. Certain exemplary embodiments may be used to cool such other components.

In one or more exemplary embodiments, the light chamber 130 of the light fixture 100 is an enclosure inside of which the light source 120 is positioned. The light chamber 130 may protect the light source 120 from debris, dust, and/or other elements that may cause the light source 120 to deteriorate and/or stop working properly. The light chamber 130 may filter, reflect, and/or otherwise manipulate the light generated by the light source 120. The light chamber 130 may be made of any suitable material, including glass, plastic, some other material, or any combination thereof. The housing 102 may have a size, thickness, weight, shape, and/or other characteristics that comply with a standard, regulation, application, and/or any other requirement of the lighting fixture 100.

The light chamber 130 may be coupled to the housing 102. The light chamber 130 may be coupled to the housing 102 in one or more of a number of ways, including but not limited to fastening devices, epoxy, a threaded coupling, a clamp, a compression fitting, and welding. The light chamber 130 may swing outward (i.e., an open position) from the housing 102 using one or more hinges. In one or more exemplary embodiments, there are no hinges, and the light chamber 130 is separated from the housing 102 when the coupling mechanism(s) are removed.

In one or more exemplary embodiments, all or a portion of the light source is located inside the housing 102. In addition, or in the alternative, the light chamber 130 may be omitted. Further, the light chamber may be integrated with the housing 102. For example, the light chamber may be all or part of a surface (e.g., a wall) of the housing 102.

Figure 2:
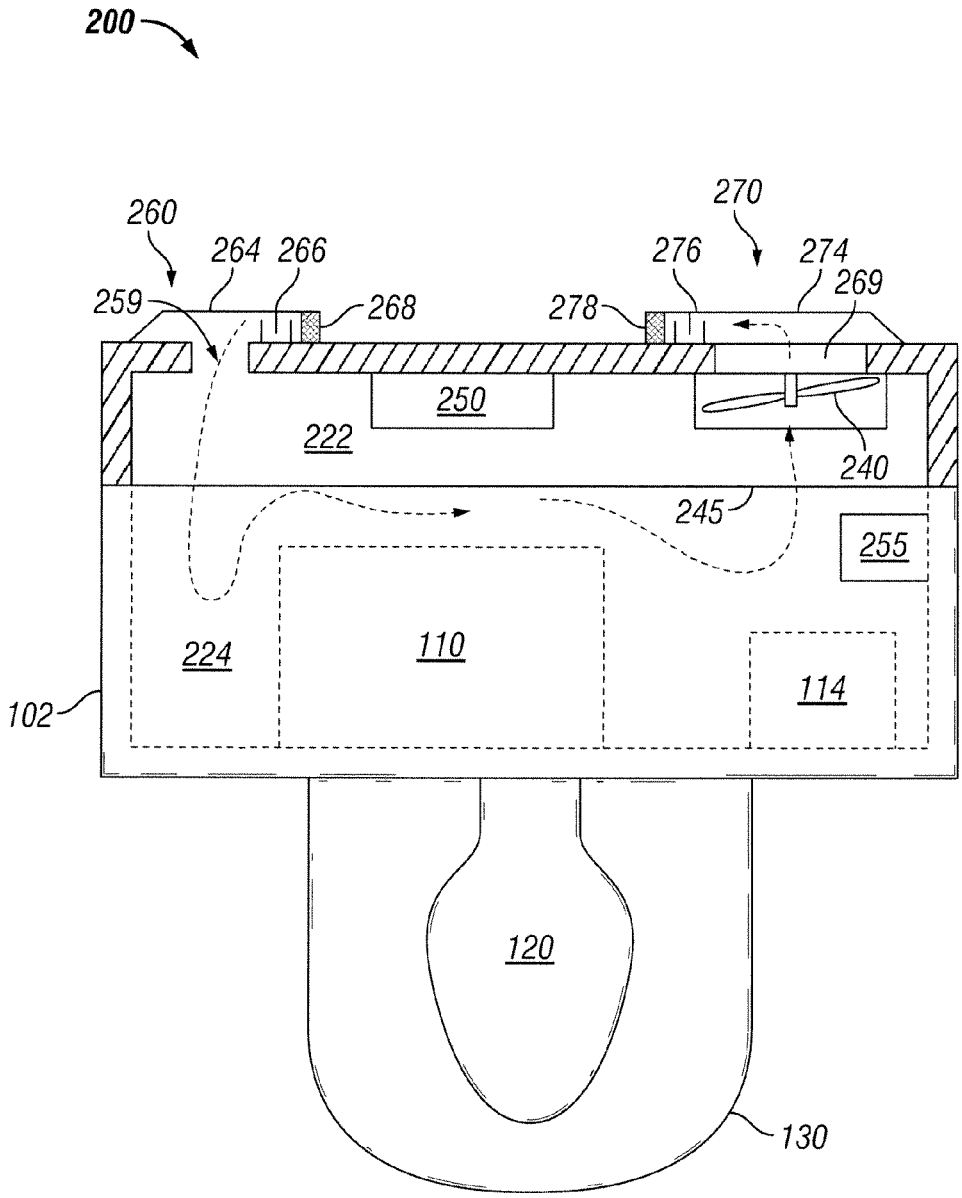
FIG. 2 shows an exemplary system for cooling heat-generating components of a light fixture in accordance with one or more exemplary embodiments.

FIG. 2 shows an example light fixture 200 in which components are cooled using airflow in accordance with one or more exemplary embodiments. Features shown but not described and/or labeled in FIG. 2 are described and/or labeled above with respect to FIG. 1. Exemplary embodiments of cooling heat-generating components using airflow inside a light fixture are not limited to the configuration shown in FIG. 2 and discussed herein.

FIG. 2 shows a light fixture 200 from the perspective of a cross-sectional frontal view of the interior of the light fixture 200 having a housing 102 and a light chamber 130. In one or more exemplary embodiments, the housing 102 of the light fixture 200 includes an air moving device 240, a controller 250, a measuring device 255, an optional housing separator 245, an inlet aperture 259, an inlet covering assembly 260, an outlet aperture 269, an outlet covering assembly 270, the driver 110, and the capacitor 114. The light chamber 130 in FIG. 2 includes the light source 120.

In certain exemplary embodiments, the optional housing separator 245 divides the housing 102 into two or more regions. For example, in FIG. 2, the housing 102 of the light fixture 200 is divided into a first region 222 (i.e., the relatively low temperature portion of the interior of the housing 102) and a second region 224 (i.e., the relatively high temperature portion of the interior of the housing 102). The first region 222 may have an equal or lower temperature than the second region 224 while one or more heat-generating components (e.g., driver 110, capacitor 114), located within the second region 224, are operating. In this case, the housing separator 245 is a baffle that is positioned substantially horizontally within the housing 102. In the example shown in FIG. 2, the inlet aperture 259 is located in the first region 222, and the outlet aperture 269 is located in the second region 224.

The housing separator 245 may be configured in one or more of a number of ways. For example, the housing separator 245 may have a substantially identical length, width, and or height as the interior of the housing 102. As another example, the housing separator 245 may be a solid surface and/or have a number of holes (e.g., perforations, openings) to allow air to flow from one region to another region inside the housing 102. The housing separator 245 may include one or more pieces oriented in one or more of a number of two-dimensional planes and/or three-dimensional spaces. In certain exemplary embodiments, as described below with respect to FIG. 3B, the housing separator 245 may also include one or more connecting apertures between the housing 102 and the light chamber 130.

The housing separator 245 may be made of one or more of a number of materials, including but not limited to metal (e.g., aluminum), plastic, composite fiber, and ceramic. The housing separator 245 may be coupled to one or more walls of the interior of the housing 102 using one or more of a number of ways, including but not limited to welding, mating threads, fastening devices (e.g., screws, bolts), compression fittings, and epoxy. In certain exemplary embodiments, the housing separator 245 may be omitted from the housing 102.

As shown in FIG. 2, the air moving device 240 and the controller 250 are located in the first region 222. Specifically, the air moving device 240 in FIG. 2 is placed proximate to the outlet aperture 269. The air moving device 240, and/or one or more additional air moving devices 240, may be placed at any other point within the housing 102, including but not limited to adjacent to the inlet aperture 259 in the first region 222, some other location in the first region 222, and in the second region 224. The air moving device 240 may be reversible. Specifically, the polarity of the air moving device 240 may be capable of moving air in one direction and/or in an opposite direction. The polarity of the air moving device 240 may be set and/or changed by the controller 250 and/or by a switch (which may be mounted in one or more of a number of locations, including but not limited to an outer surface of the light fixture 200 and a remote location).

The air moving device 240 may be a blower, a fan, or some similar device that is configured to move air. The air moving device 240 may include a motor that is used to control the flow of air (e.g., exhaust air) within the light fixture 100, and specifically within the housing 102. The air moving device 240 may be configured to move air inside the housing 102 and/or the light chamber 130. Specifically, the air moving device 240 may be configured to draw intake air from outside the housing 102, move intake air and/or exhaust air within the housing 102 and/or the light chamber 130, and/or remove exhaust air from the interior of the housing 102. For example, the air moving device 240 may draw intake air from outside of the housing 102 through the inlet aperture 259 into the first region 222. As another example, the air moving device 240 may remove the exhaust air from the second region 224 through the outlet aperture 269 to outside of the housing 102. The air moving device 240 may drive a differential pressure within the interior of the housing 102 and/or the light chamber 130 to create the air flow.

The air moving device 240 may draw inlet air from outside the light fixture 200 (and specifically, from outside the housing 102) through one or more inlet apertures 259 that traverse a wall of the housing 102. In one or more exemplary embodiments, an inlet covering assembly 260 is incorporated into the one or more inlet apertures 259 in the housing 102. Specifically, the inlet covering assembly 260 may be coupled to an outer surface of the housing 102. The inlet covering assembly 260 may cover one or more inlet apertures 259 in a wall of the housing 102. In one or more exemplary embodiments, as shown in FIG. 2, the inlet aperture 259 in the wall of the housing 102 is located in, or adjacent to, the first region 222 of the housing 102. Alternatively, the inlet aperture 259 is located in the second region 224 of the housing 102.

In one or more exemplary embodiments, the inlet covering assembly 260 includes an inlet cover 264 that covers the aperture in the housing 102 caused by the inlet aperture 260. The inlet cover 264 also includes at least one opening through which the intake air enters the inlet aperture 259. The opening in the inlet cover 264 may be bounded by an outer surface of the housing 102, as shown in FIG. 2. The opening in the inlet cover 264 may also, or in the alternative, be at some point in the inlet cover 264 away from the outer surface of the housing 102. The opening in the inlet cover 264 may include the inlet filter 268 and/or a baffled inlet 266, described below. The size of the opening in the inlet cover 264 may vary based on one or more of a number of factors, including but not limited to a desired air flow rate and whether the inlet covering assembly 260 includes a baffled inlet 266 and/or an inlet filter 268.

In certain exemplary embodiments, the size of the inlet cover 264 where the inlet cover 264 couples to the outer surface of the housing 102 is at least as large as the inlet aperture 259. The inlet cover 264 may couple to the outer surface of the housing 102 in one or more of a number of ways, including but not limited to welding, mating threads, fastening devices (e.g., screws, bolts), compression fittings, and epoxy. The inlet cover 264 may be made of one or more of a number of materials, including but not limited to rubber, stainless steel, a metal alloy, plastic, and plexiglass.

In one or more exemplary embodiments, the inlet filter 268 of the inlet covering assembly 260 is positioned at the opening of the inlet cover 264. The inlet filter may be configured to remove contaminants from the inlet air as the inlet air passes from outside the housing 102 to the interior of the housing 102. The air inlet filter 268 may also be configured to cool the inlet air as the inlet air passes from outside the housing 102 to the interior of the housing 102. The inlet aperture 260 (and its components, such as the inlet filter 268, the inlet cover 264, and/or the baffled inlet 266) may be coupled to the housing 102 in such a way, and assembled in such a way, as to meet the standards required for the light fixture. The inlet filter 268 may include a sintered filter.

Each inlet filter 268 may be configured in one of a number of different ways. In one or more exemplary embodiments, the inlet filter 268 is configured to sit substantially flush with the opening in the inlet cover 264. The inlet filter 268 may be configured to remove contaminants from the intake air as the intake air passes through the inlet filter 268 to the interior of the housing 102. Each inlet filter 268 may also be configured to cool the intake air as the intake air passes through the inlet filter 268 to the interior of the housing 102. Each inlet filter 268 may be one of a number of shapes, including but not limited to an ellipse, a rectangle, an octagon, a triangle, and a circle. Each inlet filter 268 may include, in addition to filter material, a filter holder or frame. Each inlet filter 268 may be cleaned by changing the polarity of the air moving device 240, which reverses the air flow through the inlet filter 268 from inside the housing 102 to the exterior of the light fixture 200.

In certain exemplary embodiments, the inlet covering assembly 260 also includes a baffled inlet 266. The baffled inlet 266 is configured to keep water and other liquids on the outside of the housing 102 from entering the interior of the housing 102. The baffled inlet 266 may have one or more of a number of configurations and/or shapes. For example, the baffled inlet 266, as shown in FIG. 2, has a type of sawtooth shape, where each of the teeth is a vertical protrusion that extends a partial height of the opening of the inlet cover 264, alternating between extending from the top of the opening of the inlet cover 264 and extending from the bottom of the cover of the inlet cover 264. Those skilled in the art will appreciate that other configurations of the baffled inlet 266 may exist to allow the intake air to flow to the interior of the housing 102 while preventing substantially any liquids outside the housing 102 from entering the housing 102 through the opening in the inlet cover 264.

Once the intake air is within the interior of the housing 102, the air moving device 240 is configured to pass the intake air through the housing separator 245 into the second portion 224 of the housing 102 and over one or more heat-generating components (e.g., the driver 110). In such a case, the housing separator 245 may be positioned to create the second region 224 of the interior of the housing 102 and configured to direct the intake air toward the heat-generating components in the second region 224.

As the air moving device 240 passes the intake air over the one or more heat-generating components, the intake air cools the heat-generating components. As the heat-generating components are cooled, the temperature of the intake air increases to generate exhaust air. In other words, the temperature of the exhaust air is greater than the temperature of the intake air. In one or more exemplary embodiments, the air moving device 240 is further configured to remove the exhaust air from the interior of the housing 102.

In one or more exemplary embodiments, the air moving device 240 operates continuously. Alternatively, the air moving device 240 may operate on a periodic basis. The periodic basis may be random, at a fixed interval, based on some operating parameter (e.g., the temperature inside the housing 102 exceeds a maximum threshold temperature), user preferences, some other suitable factor, or any combination thereof. The operation of the air moving device 240 may be controlled by one or more of a number of sources, including but not limited to a user (through manual operation) and the controller 250.

In one or more exemplary embodiments, the air moving device 240 (with or without the controller 250, described below) also becomes a heat-generating component. In such a case, intake air and/or the exhaust air (or a portion thereof) may be directed to and passed over the air moving device 240 to cool the air moving device 240. The intake air and/or exhaust air may be directed to and passed over the air moving device 240 using the housing separator 245 within the housing 102 created by the air moving device 240. Alternatively, or in addition, the inlet air may be directed to and passed over the air moving device 240 using some other means, including but not limited to a pressure differential and another air moving device.

In one or more exemplary embodiments, the controller 250 is a component located within the interior of the housing 102. As shown in the example in FIG. 2, the controller 250 is located in the first region 222 of the interior of the housing 102. The control 250 may be located in one or more other locations, including but not limited to outside of the housing 102, outside of the light fixture 200, and at any other location (e.g., the second region 224) within the interior of the housing 102. The controller 250 may be configured to control the operation (e.g., on/off, speed, direction/polarity) of the air moving device 240. For example, the controller 250 may be configured to start the air moving device 240, stop the air moving device 240, and increase and/or decrease the speed at which the air moving device 240 operates.

In one or more exemplary embodiments, the controller 250 is also coupled to other components. Such other components may be located within the interior of the housing 102 and/or adjacent to the housing 102. Such other components may be, or provide information related to, the operation of the air moving device 240. Examples of such other components may include, but are not limited to, a measuring device 255 (e.g., a temperature sensor, an air flow sensor), and a pushbutton.

For example, the controller 250 may be coupled to one or more measuring devices 255. A measuring device 255 may be any type of device capable of measuring one or more operating parameters inside of and/or associated with the operation of one or more components of the light fixture 200. Types of a measuring device 255 may include, but are not limited to, a sensor, a transducer, a thermocouple, and a scanner. The operating parameters measured by the measuring device 255 may include, but are not limited to, temperature, pressure, and air flow. As an example, the measuring device 255 may be configured to measure the temperature (i.e., a temperature sensor) at some point in the interior of the housing 102. In such a case, the controller 250 may determine, based on the temperature, whether the air moving device 240 should be activated (and if so, at what speed) or deactivated. As another example, the measuring device 255 may be configured to measure an air flow (i.e., an air flow sensor) at the inlet aperture. In such a case, the controller 250 may determine whether the air flow is too low and, if so, reverse the polarity of the air moving device 240 in an attempt to remove debris from the filter 268 and increase the air flow. The measuring device 255 may measure an operating parameter at any time, including when certain components (e.g., the air moving device 240) of the light fixture 200 are or are not operating.

In certain exemplary embodiments, the controller 250 is configured to receive one or more measurements taken by the measuring device 255 and compare, determine, and/or otherwise interpret such measurement. For example, when the measuring device 255 is a temperature sensor, the controller 250 receives a temperature inside the housing 102 measured by the measuring device 255. The controller 250 may also determine that the temperature measured by the measuring device 255 (in this example, the temperature sensor) exceeds a maximum temperature threshold value.

The controller 250 may also perform an action based on a measurement received from the measuring device 255. Such an action may require that the controller 250 communicates with (e.g., sends a control signal to) one or more other components of the light fixture 200. As an example, if the temperature measured by the measuring device 255 exceeds a maximum temperature threshold value, and if the temperature is measured by the measuring device 255 when the air moving device 240 is not operating (i.e., turned off), the controller 250 may send an activation signal to the air moving device 240 to start and/or regulate the speed of the air moving device 240 to lower the temperature of the heat-generating components inside the housing 102. In such a case, the controller 250 may continue to operate the air moving device 240 until the temperature inside the housing 102 falls below a minimum temperature threshold value. In such a case, the controller 250 may receive one or more measurements (in this example, temperature measurements) from the measuring device 255 and compare such measurements to a minimum temperature threshold.

When the temperature at the point in the interior of the housing 102 measured by the measuring device 255 falls below the minimum threshold temperature, then the controller 250 may send a deactivation signal to the air moving device 240 to stop (i.e., turn off) the air moving device 240. In certain exemplary embodiments, the controller 250 is a heat-generating component. The controller 250 may also be configured to communicate with a user.

Communication with a user may be conveyed directly (e.g., a siren, an indicating light, a window on a display panel mounted on the exterior of the housing 102) or indirectly (e.g., sending a signal to a control system, which processes the signal and generates an alarm).

The air moving device 250 may remove the some or all of the exhaust air from the interior of the housing 102 through one or more outlet apertures 269 (different from the inlet apertures 259 described above with respect to the intake air) in the housing 102. In one or more exemplary embodiments, an outlet covering assembly 270 is incorporated into each of the one or more outlet apertures 259 in the housing 102. Specifically, an outlet covering assembly 270 may be coupled to one or more outlet apertures 269 in a wall of the housing 102. In one or more exemplary embodiments, the outlet aperture 269 in the wall of the housing 102 is located in, or adjacent to, the first region 222 of the interior of the housing 102. The outlet apertures 259 and inlet apertures 269 may be on the same wall of the housing 102.

In one or more exemplary embodiments, the outlet covering assembly 270 includes an outlet cover 274, a baffled outlet 276, and an outlet filter 278. Each of these components of the outlet covering assembly 270 is substantially similar to the corresponding components of the inlet covering assembly 260 described above. Thus, the description above with respect to the inlet covering assembly 260 and its components may also apply to the outlet covering assembly 270 and its corresponding components. For example, the outlet covering assembly 270 may be configured to allow exhaust air to pass from the interior of the housing 102 to outside the housing 102. As another example, the outlet covering assembly 270 may include an outlet filter 278 that is sintered. As yet another example, the outlet covering assembly 270 may be coupled to an outer surface of the housing 102. In such a case, the inlet covering assembly 260 and the outlet covering assembly 270 may be coupled to the same outer surface of the housing 102. The exhaust air may have a higher temperature than the temperature of the intake air. The outlet covering assembly 270 may further be configured to meet and maintain the standards and requirements for the lighting device 200.

Figure 3A:
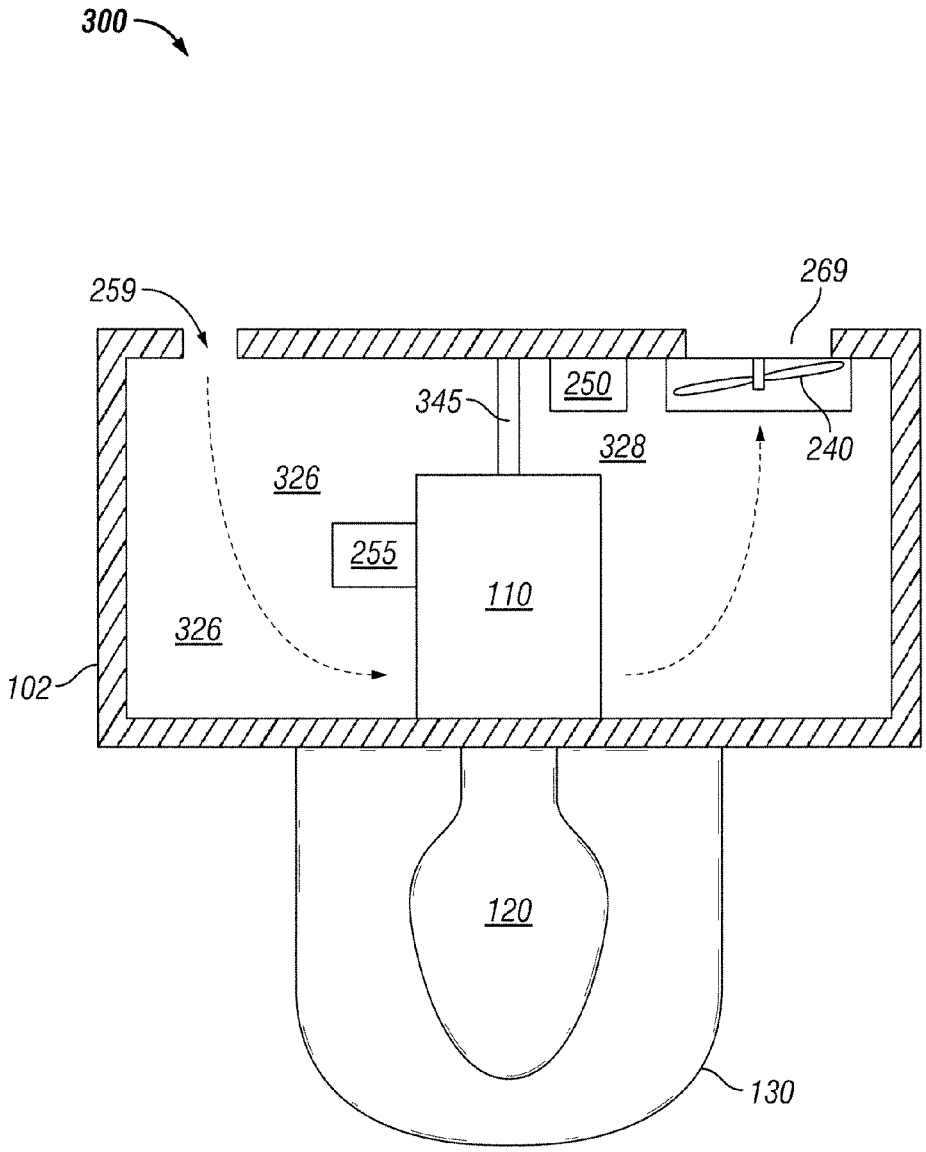
FIGS. 3A and 3B each show another exemplary system for cooling heat-generating components of a light fixture in accordance with one or more exemplary embodiments.
Figure 3B:
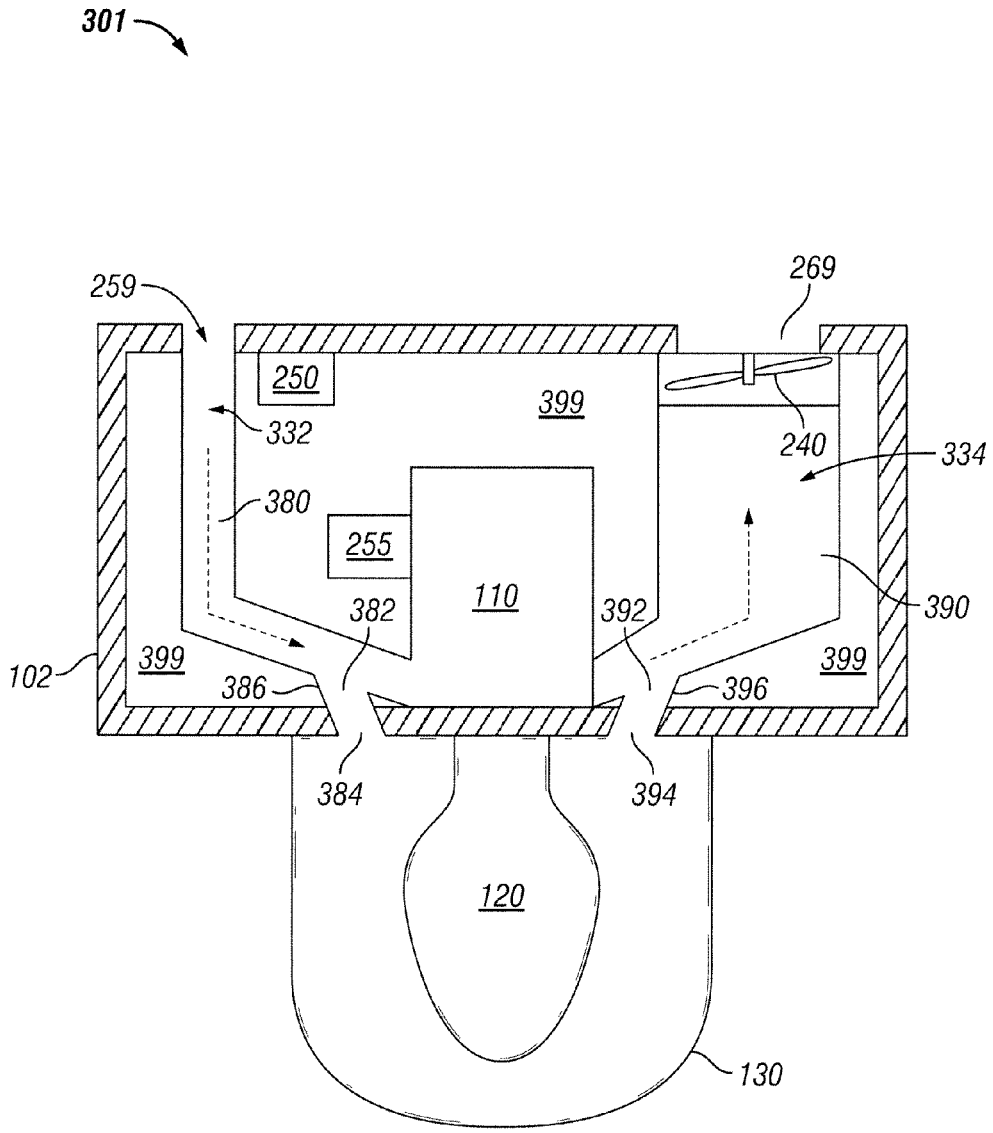

FIGS. 3A and 3B each show another exemplary system for cooling heat-generating components of a light fixture in accordance with one or more exemplary embodiments. Features shown but not described and/or labeled in FIGS. 3A and 3B are described and/or labeled above with respect to FIGS. 1 and 2. Exemplary embodiments of cooling heat-generating components using airflow inside a light fixture are not limited to the configuration shown in FIGS. 3A and 3B and discussed herein.

Referring to FIGS. 1-3B, a cross-sectional frontal view of the interior of a light fixture 300 is shown in FIG. 3A. The light fixture 300 includes a housing 102 and a light chamber 130. The housing 102 of the light fixture 300 includes an air moving device 240, a controller 250, a measuring device 255, a housing separator 245, an inlet aperture 259, an outlet aperture 269, the driver 110, and the capacitor 114. While not shown in FIG. 3A, the inlet covering assembly 260 and the outlet covering assembly 270 may be included as part of the housing 102 of the light fixture 300. The light chamber 130 in FIG. 3A includes the light source 120.

In the light fixture 300 of FIG. 3A, the housing separator 345 is a baffle that is positioned substantially vertically (as opposed to the horizontal configuration shown in FIG. 2 above) within the housing 102. Specifically, the housing separator 345 divides the housing 102 of the light fixture 300 into a first region 326 (i.e., the relatively low temperature portion of the interior of the housing 102) that includes the inlet aperture 259 and a second region 328 (i.e., the relatively high temperature portion of the interior of the housing 102) that includes the outlet aperture 269. The first region 326 may have an equal or lower temperature than the second region 328 while one or more heat-generating components (e.g., driver 110, capacitor 114) are operating.

As described above with respect to the housing separator of FIG. 2, the housing separator 345 may be configured in one or more of a number of ways. As shown in FIG. 3A, the lighting hardware (e.g., driver 110) is located within both the first region 326 and the second region 328. In this case, the housing separator 345 may have a substantially identical length as the depth of the interior of the housing 102. The height of the housing separator 345 may correspond to the distance between the top of the driver 110 and the top surface of the interior of the housing 102. Alternatively, the height of the housing separator 345 may be substantially the same as the height of the interior of the housing 102, but a cut-out portion may exist in the housing separator 345 that substantially corresponds to the profile of the driver 110. The housing separator 345 may be a solid surface and/or have a number of holes (e.g., perforations, openings) to allow air to flow from the first region 326 to the second region 328 inside the housing 102.

Referring to FIG. 3B, a cross-sectional frontal view of the interior of another light fixture 301 is shown. The light fixture 301 includes a housing 102 and a light chamber 130. The housing 102 of the light fixture 301 includes an air moving device 240, a controller 250, a measuring device 255, a housing separator (which includes duct 380, duct 386, duct 390, and duct 396), an inlet aperture 259, an outlet aperture 269, the driver 110, and the capacitor 114. While not shown in FIG. 3B, the inlet covering assembly 260 and the outlet covering assembly 270 may be included as part of the housing 102 of the light fixture 301. The light chamber 130 in FIG. 3B includes the light source 120.

In the light fixture 301 of FIG. 3B, the housing separator is ducts rather than one or more baffles. The duct 380 is positioned within the interior of the housing 102. Specifically, one end of the duct 380 is coupled to the inlet aperture 259 inside the housing 102, and the other end of the duct 380 is coupled to a portion of the driver 110. The interior of the duct 380 creates a first region 332. In addition, as an optional embodiment, the duct 386 branches off from the duct 380 starting at point 382. The duct 386 traverses a connecting aperture 384 positioned in a wall of the housing 102 and the light chamber 130. As a result, in such a case, a portion of the intake air that flows in the duct 380 passes through the driver 110, while another portion of the intake air that flows in the duct 380 is directed through the duct 386 and into the light chamber 130.

Further, the duct 390 of FIG. 3B is also positioned within the interior of the housing 102. Specifically, one end of the duct 390 is coupled to a portion (different than the portion coupled to the duct 380) of the driver 110, and the other end of the duct 390 is coupled to the outlet aperture 269 inside the housing 102. The interior of the duct 390 creates a second region 334. In addition, as an optional embodiment, the duct 396 merges into the duct 390 at point 392. The duct 396 traverses a connecting aperture 394 (different from the connecting aperture 384) positioned in a wall of the housing 102 and the light chamber 130. As a result, in such a case, a portion of the exhaust air that flows in the duct 390 is generated when a portion of the intake air flowing through the duct 380 passes through the driver 110, while another portion of the exhaust air that flows in the duct 380 is received from the light chamber 130 through the duct 386.

In certain exemplary embodiments, the duct 386 and/or the duct 396 may be optional. For example, if the duct 386 exists and the duct 396 does not exist, than the portion of the intake air that flows through the duct 386 may generate, upon passing over the light source 120 in the light chamber 130, exhaust air that flows through an aperture (not shown) in the light chamber 130. Alternatively, if the light chamber does not exist (i.e., the light source 120 is exposed outside the light fixture 301), the exhaust air generated when the portion of the intake air flows through the duct 386 and passes over the light source 120 may mix with the ambient air. As another example, if the duct 386 does not exist and the duct 396 exists, then exhaust air that is generated by the light source 120 in the lighting chamber 130 is drawn through the duct 396 and mixes with the exhaust air generated by the driver 110 in the duct 390.

In certain exemplary embodiments, when the housing separator includes one or more ducts (e.g., duct 380, duct 386, duct 390, duct 396), a third region 399 of the interior of the housing 102, defined by the space outside the ducts inside the housing 102, may be defined. The third region 399 inside the housing 102 may be an empty space having no components. Alternatively, any components positioned in outside the ducts in the third region 399 inside the housing 102 may not be heat-generating components.

Figure 4:
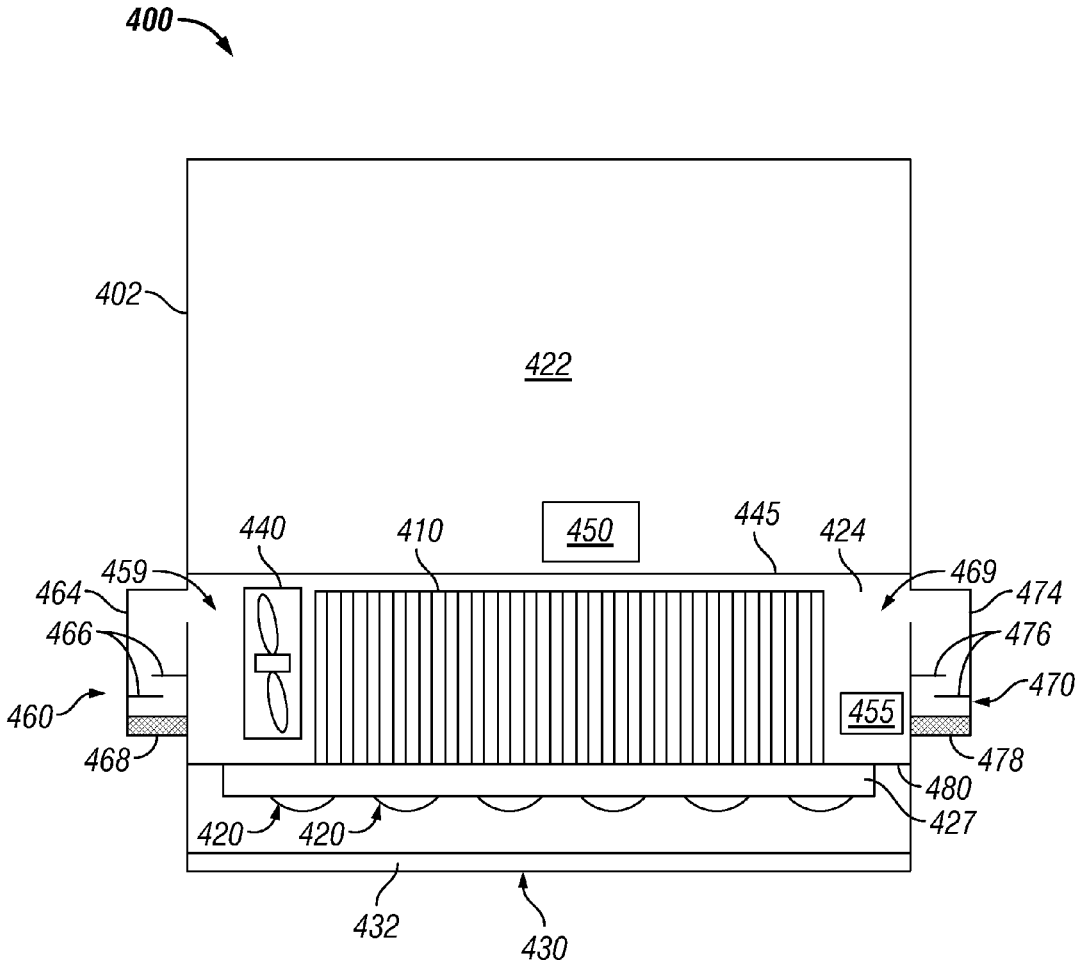
FIG. 4 shows another exemplary system for cooling heat-generating components of a light fixture in accordance with one or more exemplary embodiments.

FIG. 4 shows yet another exemplary light fixture 400 in which heat-generating components are cooled in accordance with certain exemplary embodiments. Features shown but not described and/or labeled in FIG. 4 are described and/or labeled above with respect to FIGS. 1-3B. Exemplary embodiments of cooling heat-generating components using airflow inside a light fixture are not limited to the configuration shown in FIG. 4 and discussed herein.

Referring to FIGS. 1-4, a cross-sectional frontal view of the interior of a light fixture 400 is shown in FIG. 4. In this example, the inlet covering assembly 460 (including the baffled inlet 466, the inlet cover 464, the optional inlet filter 468, and the inlet aperture 459), the outlet covering assembly 470 (including the baffled outlet 476, the outlet cover 474, the optional outlet filter 478, and the outlet aperture 469), the controller 450, the heat generating components 410, the air moving device 440, and the measuring device 455 are substantially the same as the corresponding components described above with respect to FIGS. 1-3B.

In this example, the housing 402 includes a first region 422 and a second region 424. In certain exemplary embodiments, the first region 422 and the second region 424 of the housing are physically separated by a solid housing separator 445. The housing separator 445 can be insulated to keep heat generated by one or more heat-generating components 410 (e.g., heat sink, LED driver) in the second region 424 isolated from one or more electronics devices (e.g., the controller 450) are located inside the first region 422. The housing separator 445 can provide an air-tight seal or a nearly air-tight seal between the first region 422 and the second region 424. The housing separator 445 can be made from one or more of a number of materials, including but not limited to metal, plastic, ceramic, and rubber. In certain exemplary embodiments, the housing 402 only includes the second region 424, in which case the first region 422 is a separate compartment of the light fixture and is mechanically coupled to the housing 402.

The second region 424 includes one or more heat-generating components 410, including but not limited to a heat sink and a LED driver. The second region 424 can also include the air moving device 440 and the measuring device 455, each of which are communicably coupled to the controller 450 positioned in the first region 422. The inlet aperture 459 and the outlet aperture 469 are each positioned in a wall of the second region 424 of the housing 402. Further, the inlet covering assembly 460 (including the baffled inlet 466 and the inlet cover 464) and the outlet covering assembly 470 (including the baffled outlet 476 and the outlet cover 474) are each mechanically coupled to an outer surface of the housing 402. Specifically, in this example, the inlet covering assembly 460 and the outlet covering assembly 470 are each mechanically coupled to an outer surface of the second region 424.

The light chamber 430 includes a lens 432 that serves as a bottom surface of the light chamber 430. The light chamber also includes a number of light sources 420 that are electrically and mechanically coupled to an optional housing separator 480 positioned between the second region 424 and the light chamber 430. For example, as shown in FIG. 4, the light sources 420 can be electrically and mechanically coupled to a printed circuit board (PCB) 427, which is mechanically and electrically coupled to the heat generating component 410 in the second region 424 through the housing separator 480. The housing separator 480 can have one or more of a number of characteristics, including but not limited to insulated, solid, mesh, perforated. The housing separator 480 can be made from one or more of a number of materials, including but not limited to metal, plastic, ceramic, and rubber.

In certain exemplary embodiments, the housing separator 480 is omitted, in which case the PCB 427 is mechanically coupled directly to the heat-generating component 410. If the housing separator 480 between the light chamber 430 and the second region 424 is omitted or not solid, some or all of the air flow created by the air moving device 440 can be diverted to the light chamber 430 so that air flows over the light sources 420.

Figure 5:
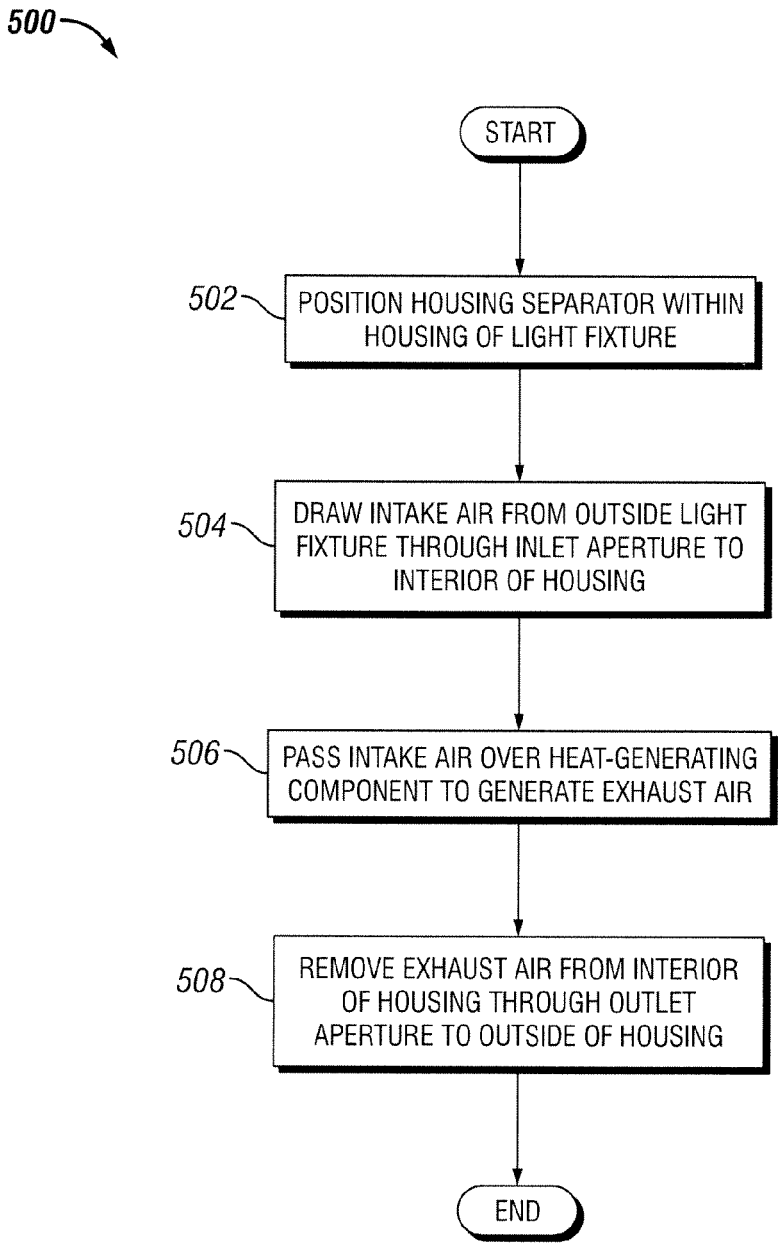
FIG. 5 shows a flowchart of a method for cooling heat-generating components of a light fixture in accordance with one or more exemplary embodiments.

FIG. 5 shows a flowchart of a method for cooling heat-generating components of a light fixture in accordance with one or more exemplary embodiments. While the various steps in this flowchart are presented and described sequentially, one of ordinary skill will appreciate that some or all of the steps may be executed in different orders, may be combined or omitted, and some or all of the steps may be executed in parallel. Further, in one or more of the exemplary embodiments of the invention, one or more of the steps described below may be omitted, repeated, and/or performed in a different order. In addition, a person of ordinary skill in the art will appreciate that additional steps, omitted in FIG. 5, may be included in performing this method. Accordingly, the specific arrangement of steps shown in FIG. 5 should not be construed as limiting the scope of the invention. In addition, one or more of the steps described herein may be performed using a computing device, such as the computing device 600 described below with respect to FIG. 6.

Referring to FIGS. 1-4, in Step 502, a housing separator is positioned within a housing of the light fixture. The housing separator may separate the housing into multiple regions. For example, one region (a first region) includes an inlet aperture in a wall of the housing. As another example, another region (a second region) includes an outlet aperture in a wall (the same wall or a different wall) of the housing. The housing separator may be one or more baffles, one or more ducts, and/or any other type of device configured to divide the interior of the housing into multiple regions. The housing includes one or more heat-generating components.

In Step 504, intake air is drawn from outside the light fixture through an inlet aperture to the interior of the housing. In one or more exemplary embodiments, the intake air is drawn to the first region of the housing. The intake air may be drawn to the interior of the housing based on input (e.g., a measurement) received from a measuring device. The intake air may be drawn to the interior of the housing one or more of a number of methods, including pressure differential, induction, and creating air flow with an air moving device (e.g., a fan, a blower). For example, an air moving device, located in either the first region or the second region, may be used to draw the inlet air from outside the housing to the interior of the housing.

A measuring device may measure one or more parameters (e.g., temperature, air flow) on the interior of the housing. In one or more exemplary embodiments, the intake air may be drawn to the interior of the housing through at least one inlet covering assembly. In such a case, the inlet covering assembly may be used cool the intake air and/or remove contaminants from the intake air before the intake air is drawn to the interior of the housing. For example, a temperature within the housing may be measured. The temperature may be measured using a temperature sensor (a type of measuring device). Each temperature within the housing may be measured when the air moving device is operating or when the air moving device is stopped (not operating).

Continuing with the example, it may be determined (using, for example, a controller) that the temperature within the housing exceeds a maximum temperature threshold. In such a case, the air moving device may be activated. The air moving device may be activated by the controller. When activated, the air moving device draws intake air from outside the light fixture to the interior of the housing through the inlet aperture. Alternatively, if the air intake device is already activated in such a case, then the air intake device may remain activated.

Optionally, a portion (e.g., a second portion) of the intake air may be directed to flow through a first connecting aperture in the first region of the housing to a light chamber of the light fixture. In certain exemplary embodiments, the light chamber includes a light source. The potion of the intake air may be directed to flow to the light chamber using the housing separator.

Further, an inlet covering assembly may be coupled to the inlet aperture. The inlet covering assembly may be used to process the intake air before the intake air enters the housing. The inlet covering assembly may process the intake air by manipulating the intake air in one or more of a number of ways, including but not limited to filtering the intake air by passing the intake air through a filter and inducing the intake air to flow through a baffled entrance.

In Step 506, a first portion of the intake air is passed over one or more heat-generating components. In certain exemplary embodiments, the intake air cools the one or more heat-generating components to generate exhaust air. The exhaust air may be sent to the second region of the housing after cooling the one or more heat-generating components. The intake air may be divided into any number of portions. In one or more exemplary embodiments, the heat-generating components are located in the second region of the housing. One or more of the heat-generating components may also, or in the alternative, be located elsewhere inside the housing, including but not limited to the first region, a space between the first region and the second region, and a third region. First exhaust air may be generated when a first portion of the intake air cools the heat-generating components, which in turn heats the first portion of the intake air. In other words, the temperature of the first exhaust air is greater than the temperature of the intake air.

Optionally, the second portion of the intake air (described above with respect to Step 504) passed over the light source in the lighting chamber. In such a case, second exhaust air may be generated when the second portion of the intake air cools the light source, which in turn heats the second portion of the intake air. In other words, the temperature of the second exhaust air is greater than the temperature of the intake air.

In Step 508, the first exhaust air is removed from the second region of the interior of the housing, through the outlet aperture, to the outside of the housing. The first exhaust air may be removed from the interior of the housing the same or a different method than the method used to draw the intake air to the interior of the housing. For example, the air moving device described above with respect to Step 504 may be used to remove the first exhaust air from the interior of the housing to the outside of the housing.

Optionally, in the case where second exhaust air has been generated in the lighting chamber as described above with respect to Step 506, the second exhaust air may also be removed from the interior of the light fixture. Specifically, the second exhaust air may be removed from the lighting chamber and/or the second region of the housing. For example, a second connecting aperture in the second region of the housing may allow the second exhaust air to flow from the lighting chamber to the second region of the housing. In such a case, the second exhaust air may be removed from the interior of the housing the same or a different method than the method used to remove the first exhaust air from the interior of the housing. For example, the air moving device described above with respect to Step 504 may be used to remove the second exhaust air from the interior of the housing to the outside of the housing.

Further, an outlet covering assembly may be coupled to the outlet aperture. The outlet covering assembly may be used to process some or all of the exhaust air as the exhaust air exits the second region of the housing. The outlet covering assembly may process the exhaust air by manipulating the exhaust air in one or more of a number of ways, including but not limited to filtering the exhaust air by passing the exhaust air through a filter and forcing the exhaust air to flow through a baffled exit.

In certain exemplary embodiments, the first region of the housing may not an opening aperture, but the second region of the housing may have an opening aperture. In such a case, the exhaust air generated by passing the intake air over the heat-generating components positioned inside the housing may be divided into a first exhaust air and a second exhaust air, where the first exhaust air passes through the second region of the housing and through the outlet aperture to exit the housing, and the second exhaust air flows through the connecting aperture in the second region of the housing to the light chamber of the light fixture.

In certain exemplary embodiments, when the temperature within the housing (as measured, for example, by the temperature sensor) is less than a minimum temperature threshold (as determined, for example, by the controller), the air moving device may be deactivated (i.e., stopped) so that intake air is no longer drawn from outside the housing of the light fixture. Alternatively, if the air intake device is already deactivated in such a case, then the air intake device may remain deactivated.

Figure 6:
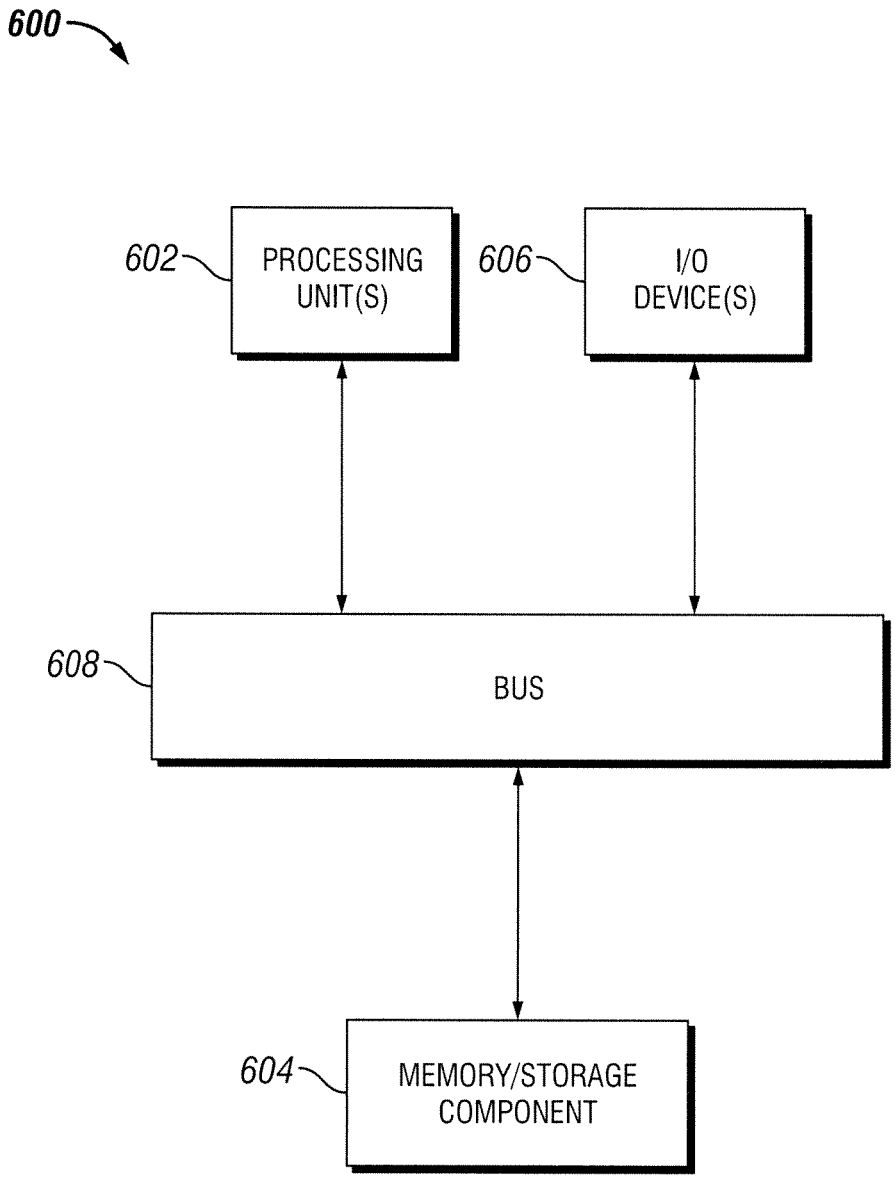
FIG. 6 shows a computing device in accordance with one or more exemplary embodiments.

FIG. 6 illustrates one embodiment of a computing device 600 that can implement one or more of the various techniques described herein, and which may be representative, in whole or in part, of the elements described herein. Computing device 600 is only one example of a computing device and is not intended to suggest any limitation as to scope of use or functionality of the computing device and/or its possible architectures. Neither should computing device 600 be interpreted as having any dependency or requirement relating to any one or combination of components illustrated in the example computing device 600.

Computing device 600 includes one or more processors or processing units 602, one or more memory/storage components 604, one or more input/output (I/O) devices 606, and a bus 608 that allows the various components and devices to communicate with one another. Bus 608 represents one or more of any of several types of bus structures, including a memory bus or memory controller, a peripheral bus, an accelerated graphics port, and a processor or local bus using any of a variety of bus architectures. Bus 608 can include wired and/or wireless buses.

Memory/storage component 604 represents one or more computer storage media. Memory/storage component 604 may include volatile media (such as random access memory (RAM)) and/or nonvolatile media (such as read only memory (ROM), flash memory, optical disks, magnetic disks, and so forth). Memory/storage component 604 can include fixed media (e.g., RAM, ROM, a fixed hard drive, etc.) as well as removable media (e.g., a Flash memory drive, a removable hard drive, an optical disk, and so forth).

One or more I/O devices 606 allow a customer, utility, or other user to enter commands and information to computing device 600, and also allow information to be presented to the customer, utility, or other user and/or other components or devices. Examples of input devices include, but are not limited to, a keyboard, a cursor control device (e.g., a mouse), a microphone, and a scanner. Examples of output devices include, but are not limited to, a display device (e.g., a monitor or projector), speakers, a printer, and a network card.

Various techniques may be described herein in the general context of software or program modules. Generally, software includes routines, programs, objects, components, data structures, and so forth that perform particular tasks or implement particular abstract data types. An implementation of these modules and techniques may be stored on or transmitted across some form of computer readable media. Computer readable media may be any available non-transitory medium or non-transitory media that can be accessed by a computing device. By way of example, and not limitation, computer readable media may comprise "computer storage media".

"Computer storage media" and "computer readable medium" include volatile and non-volatile, removable and non-removable media implemented in any method or technology for storage of information such as computer readable instructions, data structures, program modules, or other data. Computer storage media include, but are not limited to, computer recordable media such as RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by a computer.

The computer device 600 may be connected to a network (not shown) (e.g., a local area network (LAN), a wide area network (WAN) such as the Internet, or any other similar type of network) via a network interface connection (not shown). Those skilled in the art will appreciate that many different types of computer systems exist (e.g., desktop computer, a laptop computer, a personal media device, a mobile device, such as a cell phone or personal digital assistant, or any other computing system capable of executing computer readable instructions), and the aforementioned input and output means may take other forms, now known or later developed. Generally speaking, the computer system 600 includes at least the minimal processing, input, and/or output means necessary to practice one or more embodiments.

Further, those skilled in the art will appreciate that one or more elements of the aforementioned computer device 600 may be located at a remote location and connected to the other elements over a network. Further, one or more embodiments may be implemented on a distributed system having a plurality of nodes, where each portion of the implementation (e.g., controller 260, air moving device 240) may be located on a different node within the distributed system. In one or more embodiments, the node corresponds to a computer system. Alternatively, the node may correspond to a processor with associated physical memory. The node may alternatively correspond to a processor with shared memory and/or resources.

The following description (in conjunction with FIGS. 1 through 6) describes a few examples in accordance with one or more exemplary embodiments. The examples are for controlling airflow inside a light fixture. Terminology used in FIGS. 1 through 6 may be used in the example without further reference to FIGS. 1 through 6.

Example

Consider the following example, shown in FIGS. 7A through 7D, which describes cooling heat-generating components located inside a housing of a light fixture in accordance with one or more exemplary embodiments described above. In this example, the housing and its components are substantially similar to the housing and heat-generating components described above with respect to FIGS. 1 through 3B. Further, in this example, the measuring device of FIGS. 2 through 3B measures the temperature inside the housing. In addition, one or more housing separators are positioned within the interior of the housing 102 to direct the intake air drawn into the housing 102 toward one or more heat-generating components within the housing 102.

Figure 7A:
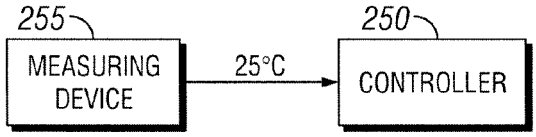
FIGS. 7A through 7D show an example in accordance with one or more exemplary embodiments.

FIG. 7A shows that the measuring device 255 measures the temperature inside the housing 102 as 25° C. A signal is sent from the measuring device 255 to the controller 250 notifying the controller 250 that the temperature inside the housing is 25° C. In this example, the controller 250 is configured to activate the air moving device 240 when the temperature inside the housing 102 is 40° C. (the maximum temperature threshold) or higher. The controller 250 is further configured to reduce, once the air moving device 240 is activated (in operation), the rate at which the air moving device 240 operates as the temperature inside the housing 102 is less than 38° C. Finally, the controller 250 is further configured to stop the air moving device 240 when the temperature inside the housing 102 is less than 37° C. Because the temperature inside the housing 102 is 25° C., the controller 250 does not start (activate) the air moving device (not shown in FIG. 7A).

Figure 7B:
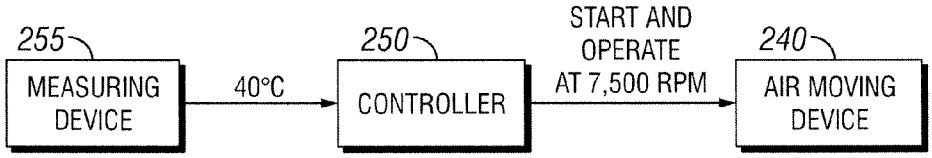

At some point later in time, FIG. 7B shows that the measuring device 255 measures the temperature inside the housing 102 as 40° C. A signal is sent from the measuring device 255 to the controller 250 notifying the controller 250 that the temperature inside the housing 102 is 40° C. Because the temperature is at the maximum temperature threshold of 40° C., the controller 250 sends an activation signal to the air moving device 240. Specifically, the activation signal sent by the controller 250 instructs the air moving device 240 to activate and to operate at 7,500 rotations per minute (rpm).

Figure 7C:
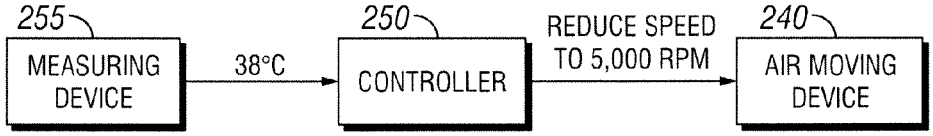

Subsequently, as shown in FIG. 7C, as the air moving device 240 continues to operate and the resulting airflow through the housing lowers the temperature inside the housing 102, the measuring device 255 measures the temperature inside the housing 102 as 38° C. A signal is sent from the measuring device 255 to the controller 250 notifying the controller 250 that the temperature inside the housing 102 is 38° C. Because the temperature inside the housing 102 is 38° C., the controller 250 reduces the rate at which the air moving device 240 operates from 7,500 rpm to 5,000 rpm.

Figure 7D:
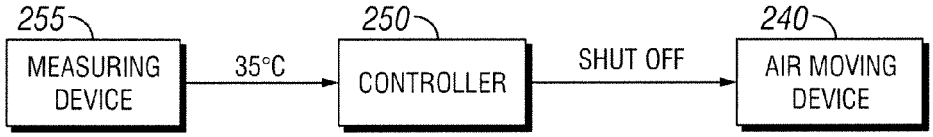

Subsequently, as shown in FIG. 7D, as the air moving device 240 continues to operate and the resulting airflow through the housing 102 continues to lower the temperature inside the housing 102, the measuring device 255 measures the temperature inside the housing 102 as 35° C. A signal is sent from the measuring device 255 to the controller 250 notifying the controller 250 that the temperature inside the housing 102 is 35° C. Because the temperature inside the housing 102 is below 37° C., the controller 250 stops (deactivates) the air moving device 710.

One or more exemplary embodiments provide for cooling heat-generating components located inside a housing and/or lighting chamber of a light fixture. Specifically, one or more exemplary embodiments are configured to use one or more air moving devices within the interior of the housing. In such a case, the air moving device may control the amount of air flowing through the housing to lower the temperature inside the housing. The temperature on the interior of the housing may increase to levels that may be detrimental to the operation of one or more components and/or devices located inside the housing. The increase in temperature on the interior of the housing may be caused by one or more heat-generating components.

Exemplary embodiments described herein may use one or more housing separators, in conjunction with the air moving device, to control the airflow inside the housing to maintain an acceptable temperature that assures continued operation of the components and/or devices located inside the housing while also maintaining the standards and/or requirements for the light fixture. As a result, use of exemplary embodiments described herein may allow for the inclusion of one or more heat-generating components within the interior of the housing without affecting the operation of the devices and/or components located inside, or associated with, the housing. Consequently, exemplary embodiments described herein may lower equipment and maintenance costs, allow for easier maintenance, and increase reliability.

Although cooling heat-generating components located inside a housing and/or lighting chamber of a light fixture is described with reference to preferred embodiments, it should be appreciated by those skilled in the art that various modifications are well within the scope of cooling heat-generating components located inside a housing and/or lighting chamber of a light fixture. From the foregoing, it will be appreciated that an embodiment of cooling heat-generating components located inside a housing and/or lighting chamber of a light fixture overcomes the limitations of the prior art. Those skilled in the art will appreciate that cooling heat-generating components located inside a housing and/or lighting chamber of a light fixture is not limited to any specifically discussed application and that the exemplary embodiments described herein are illustrative and not restrictive. From the description of the exemplary embodiments, equivalents of the elements shown therein will suggest themselves to those skilled in the art, and ways of constructing other embodiments of cooling heat-generating components located inside a housing and/or lighting chamber of a light fixture will suggest themselves to practitioners of the art. Therefore, the scope of cooling heat-generating components located inside a housing and/or lighting chamber of a light fixture is not limited herein.

What is claimed is:

1. A cooling system for a light fixture, the system comprising:

a housing comprising a plurality of walls and a heat-generating component positioned between the plurality of walls;

an inlet aperture disposed in a first wall of the plurality of walls;

an outlet aperture disposed in a second wall of the plurality of walls;

a first housing separator mechanically coupled to at least one of the plurality of walls and separating the housing into a first region and a second region, wherein the first region comprises the inlet aperture and the outlet aperture, wherein the first housing separator comprises a thermally insulating material; and an air moving device positioned within the housing and mechanically coupled to at least one of the plurality of walls.

2. The cooling system of claim 1, wherein the second region comprises a space within the housing that lacks a heat-generating component, and wherein the second region of the housing is insulated.

3. The cooling system of claim 1, wherein the heat-generating component is located within the first region of the housing.

4. The cooling system of claim 1, wherein the air moving device is positioned adjacent to the inlet aperture within the first region.

5. The cooling system of claim 1, wherein the air moving device is positioned in front of the outlet aperture within the first region.

6. The cooling system of claim 1, wherein the inlet aperture is covered by an inlet covering assembly, wherein the inlet covering assembly comprises a baffled entrance, wherein the baffled entrance is configured to prevent liquids from entering the housing.

7. The cooling system of claim 6, wherein the inlet covering assembly is mounted on a first outer surface of the housing.

8. The cooling system of claim 7, wherein the outlet aperture is covered by an outlet covering assembly, wherein the outlet covering assembly comprises a baffled exit.

9. The cooling system of claim 8, wherein the outlet covering assembly is mounted on a second outer surface of the housing.

10. The cooling system of claim 9, wherein the inlet covering assembly and the outlet covering assembly each further comprises a filter.

11. The cooling system of claim 1, wherein the heat-generating component comprises at least one selected from a group consisting of a driver, a heat sink, a light source, and a capacitor.

12. The cooling system of claim 1, further comprising:

a controller positioned within the housing, mechanically coupled to at least one of the plurality of walls, and communicably coupled to a temperature sensor and the air moving device.

13. A cooling system for a light fixture, the cooling system comprising:

an inlet aperture in a first wall of a first region of a housing of the light fixture, wherein the first region of a housing comprises a heat-generating component and is separated from a second region of the housing by a first housing separator, wherein the first housing separator comprises a thermally insulating member;

an inlet covering assembly that is coupled to a first surface of the first region of the housing and covers the inlet aperture, wherein the inlet covering assembly comprises a baffled entrance;

an outlet aperture in a second wall of the first region of the housing;

an outlet covering assembly that is coupled to a second surface of the first region of the housing and covers the outlet aperture, wherein the outlet covering assembly comprises a baffled exit; and an air moving device positioned within the first region of the housing.

14. The cooling system of claim 13, further comprising:

a controller communicably coupled to the air moving device and positioned within the second region of the housing.

15. A method for cooling heat-generating components of a light fixture, the method comprising:

drawing intake air from outside the light fixture through an inlet aperture into a first region of a housing of the light fixture, wherein the first region of the housing is separated from a second region of the housing by a first housing separator, wherein the first housing separator comprises a thermally insulating member;

passing the intake air over a heat-generating component disposed in the first region of the housing, wherein the intake air cools the heat-generating component to generate exhaust air; and removing the exhaust air from the first region of the housing through an outlet aperture disposed in the first region of the housing.

16. The method of claim 15, further comprising:

inducing the intake air to flow through a baffled entrance at the inlet aperture prior to the intake air entering the first region of the housing.

17. The method of claim 15, further comprising:

forcing the exhaust air to flow through a baffled exit at the outlet aperture after the exhaust air exits the first region of the housing.

18. The method of claim 15, further comprising:

measuring a plurality of temperatures within the first region of the housing;

determining that a first temperature of the plurality of temperatures exceeds a maximum temperature threshold; and activating, based on determining that the first temperature exceeds the maximum temperature threshold, an air moving device, wherein the air moving device draws the intake air from outside the light fixture.

19. The method of claim 18, further comprising:

determining, while the air moving device draws the intake air, that a second temperature of the plurality of temperatures is less than a minimum temperature threshold; and deactivating, based on determining that the second temperature is less than the minimum temperature threshold, the air moving device to stop drawing the intake air from outside the light fixture.

20. The cooling system of claim 12, wherein the controller is positioned in the second region of the housing.

21. The cooling system of claim 1, further comprising:

a measuring device positioned within the first region of the housing.

22. The cooling system of claim 21, wherein the measuring device is a temperature sensor.

23. The cooling system of claim 1, further comprising:

a light chamber positioned within the housing, wherein the light chamber is thermally coupled to the heat-generating component.

24. The cooling system of claim 23, further comprising:

a second housing separator that separates the light chamber from the first region of the housing.

25. The cooling system of claim 13, wherein the first surface is outside the housing.

26. The cooling system of claim 13, wherein the second surface is outside the housing.

27. The cooling system of claim 13, wherein the inlet covering assembly further comprises a filter.

28. The cooling system of claim 27, wherein the filter is disposed at an opening of the inlet covering assembly.

29. The cooling system of claim 27, wherein the filter is sintered.

30. The method of claim 15, further comprising:

positioning a housing separator within the housing of the light fixture, wherein the housing separator separates the housing into a first region and a second region, wherein the first region comprises the inlet aperture disposed in a first wall of the housing and an outlet aperture disposed in a second wall of the housing.

* * * * *